US008916039B2

(12) United States Patent
Inoue et al.

(10) Patent No.: US 8,916,039 B2
(45) Date of Patent: Dec. 23, 2014

(54) ALUMINUM OR ALUMINUM ALLOY BARREL ELECTROPLATING METHOD

(75) Inventors: Manabu Inoue, Tokyo (JP); Tadahiro Ohnuma, Tokyo (JP); Toshiki Inomata, Tokyo (JP); Tsutomu Miyadera, Saitama (JP)

(73) Assignees: Dipsol Chemicals Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 96 days.

(21) Appl. No.: 13/502,442

(22) PCT Filed: Oct. 19, 2010

(86) PCT No.: PCT/JP2010/068328

§ 371 (c)(1),
(2), (4) Date: Apr. 17, 2012

(87) PCT Pub. No.: WO2011/049066

PCT Pub. Date: Apr. 28, 2011

(65) Prior Publication Data

US 2012/0205249 A1 Aug. 16, 2012

(30) Foreign Application Priority Data

Oct. 19, 2009 (JP) ..... 2009-240422

(51) Int. Cl.

| | |
|---|---|
| ***C25D 5/00*** | (2006.01) |
| ***C25D 17/20*** | (2006.01) |
| ***C25D 3/56*** | (2006.01) |
| ***C25D 5/04*** | (2006.01) |
| ***C25D 3/66*** | (2006.01) |
| ***C25D 7/00*** | (2006.01) |
| *C25D 3/44* | (2006.01) |

(52) U.S. Cl.

CPC *C25D 17/20* (2013.01); *C25D 3/44* (2013.01); *C25D 3/56* (2013.01); *C25D 5/04* (2013.01); *C25D 3/665* (2013.01); *C25D 7/001* (2013.01)

USPC ..... 205/143; 205/237; 204/213; 204/214

(58) Field of Classification Search

USPC ..... 205/143, 96, 97; 204/213, 214

See application file for complete search history.

(56) References Cited

U.S. PATENT DOCUMENTS

| | | | |
|---|---|---|---|
| 1,531,417 | A | 3/1925 | Schulte |
| 1,609,357 | A | 12/1926 | Hulmer |

(Continued)

FOREIGN PATENT DOCUMENTS

| | | | |
|---|---|---|---|
| CN | 87100668 | A | 12/1987 |
| CN | 1236024 | A | 11/1999 |

(Continued)

OTHER PUBLICATIONS

Yoshiaki, Hoshino, NP Series, Bareru Mekki (Barrel Plating), First Edition, Maki Shoten, (1995) pp. 8-9, pp. 24-26, pp. 127-128.

(Continued)

*Primary Examiner* — Bryan D Ripa
(74) *Attorney, Agent, or Firm* — Hoffmann & Baron, LLP

(57) ABSTRACT

To provide a barrel electroplating method which is less prone to bare spots and adhesion failure such as blisters and peeling, and which makes it possible to obtain uniform plated coatings free from burnt deposits and poor brightness, irrespective of the amount of workpieces.

The present invention provides a method for performing barrel electroplating by use of an aluminum or aluminum alloy plating bath, the method comprising rotating, swinging, or vibrating an anode (6) placed inside a barrel (4) receiving workpieces, and simultaneously rotating, swinging, or vibrating the barrel, with a voltage being applied between the anode and a cathode provided on an inner wall surface of the barrel.

5 Claims, 6 Drawing Sheets

(56) References Cited

U.S. PATENT DOCUMENTS

| | | | | | |
|---|---|---|---|---|---|
| 2,865,831 | A | * | 12/1958 | Ransohoff | 204/213 |
| 3,379,631 | A | * | 4/1968 | Henig | 204/213 |
| 4,066,515 | A | * | 1/1978 | Stoger et al. | 205/143 |
| 4,596,636 | A | * | 6/1986 | Lucas | 205/211 |
| 4,661,213 | A | | 4/1987 | Dorsett et al. | |
| 5,215,641 | A | | 6/1993 | Birkle et al. | |
| 6,059,952 | A | | 5/2000 | Kang et al. | |
| 6,361,676 | B1 | * | 3/2002 | Horie et al. | 205/143 |
| 2005/0199506 | A1 | | 9/2005 | Toben et al. | |
| 2009/0188807 | A1 | | 7/2009 | Egli et al. | |
| 2009/0236227 | A1 | * | 9/2009 | Kuzmanovic et al. | 205/80 |
| 2010/0285322 | A1 | * | 11/2010 | Inoue et al. | 428/457 |
| 2011/0000793 | A1 | | 1/2011 | Kruse et al. | |

FOREIGN PATENT DOCUMENTS

| | | | | |
|---|---|---|---|---|
| CN | 1498288 | A | | 5/2004 |
| CN | 1590596 | A | | 3/2005 |
| EP | 2130949 | A1 | * | 12/2009 |
| GB | 190920057 | A | | 9/1910 |
| GB | 1230375 | A | * | 4/1971 |
| GB | 342477 | A | | 2/1981 |
| JP | 49-130 | A | | 1/1974 |
| JP | 60-190599 | | | 9/1985 |
| JP | 02-153100 | A | * | 6/1990 |
| JP | 10-072699 | | | 3/1998 |
| JP | 2005-060822 | A1 | | 10/2005 |
| JP | 2006348317 | A | | 12/2006 |
| JP | 2008031551 | A | | 2/2008 |
| JP | 2008195988 | A | | 8/2008 |
| JP | 2008195989 | A | | 8/2008 |
| JP | 2008195990 | A | | 8/2008 |
| JP | 2009-185381 | A1 | | 8/2009 |
| JP | 2009-235486 | A | | 10/2009 |
| WO | WO2009/106269 | A1 | | 9/2009 |

OTHER PUBLICATIONS

International Search Report PCT/JP2010/068328 mailed Nov. 30, 2010.

Extended European Search Report for EP 10824915.2 dated May 4, 2013.

Office Action issued to Japanese Application No. 2009240422 mailed on Mar. 18, 2013.

Chinese Office Action issued on Feb. 8, 2014.

Chinese Office Action and Search Report issued on Jun. 13, 2014.

Lei Bangxiong, "Electroplating Apparatus", Sichuan Science and Technology Press, Dec. 31, 1986, pp. 118-119.

Yang Pei-xia, et al., "Electrodeposition of Metals in Ionic Liquids", Electroplating & Pollution Control, vol. 26, No. 5, Sep. 30, 2006, pp. 1-5.

Yang Haiyan, et al., "Research Progress in Electrodeposition in Ionic Liquids", Materials Review, vol. 23, No. 3, Mar. 31, 2009, pp. 17-21.

Zhang Xin, et al., "Research Progress on Electrodeposited Al and its alloys from Ionic Liquids on Room Temperature", China Nonferrous Metallurgy, No. 2, Apr. 30, 2009, pp. 63-67.

* cited by examiner

PRIOR ART

ALUMINUM OR ALUMINUM ALLOY BARREL ELECTROPLATING METHOD

CROSS-REFERENCE TO RELATED APPLICATIONS:

This application is a 371 National Stage Filing, of PCT Application No. PCT/JP2010/068328, filed Oct. 19, 2010, which claims the benefit to Japanese Application No. 2009-240422, filed Oct. 19, 2009, the contents of which are incorporated by reference herein.

TECHNICAL FIELD

The present invention relates to a barrel plating method, and particularly to an aluminum or aluminum alloy barrel electroplating method for small parts such as bolts and screws.

BACKGROUND ART

Japanese Patent Application Publication No. Sho 49-130 (Patent Document 1) describes a method and apparatus for rotatably supporting a barrel in a plating tank. The plating apparatus described in the document has a barrel configured to receive workpieces, a cathode inserted into the barrel and configured to be brought into contact with the workpieces, and an anode placed outside the barrel.

FIG. 6 is a cross-sectional view schematically showing one example of a barrel plating apparatus used in a conventional barrel electroplating method. As shown in FIG. 6, the conventional barrel electroplating apparatus 100 has a barrel 104 rotatably supported in a plating tank 102. Workpieces W are received inside the barrel 104. In addition, cathodes 106 are placed inside the barrel 104 and configured to be brought into contact with workpieces W received in the barrel 104. On the other hand, an anode 108 is placed in the plating tank 102, but outside the barrel 104. For plating, while the barrel is being rotated, a voltage is applied between the anode 108 and the cathodes 106, and thus a current flows between the anode 108 and the workpieces W in contact with the cathodes 106.

CITATION LIST

Patent Literature

Patent Literature 1: Japanese Patent Application Publication

SUMMARY OF INVENTION

Technical Problems

When electroplating is conducted by use of the barrel plating apparatus described in Japanese Patent Application Publication No. Sho 49-130, a cathodic potential is applied to workpieces by bringing the workpieces into contact with the cathodes inserted into the barrel. Accordingly, when the quantity of the workpieces in the barrel is small, there is a problem that sufficient contact of the cathodes with the workpieces and sufficient contact of the workpieces with one another are not ensured, causing electrical continuity failure in some of the workpieces. Even when electrical continuity failure occurs in only one of the large number of the workpieces, bipolar phenomenon occurs, causing bare spots, adhesion failure, and non-uniform plating, so that favorable plated coatings cannot be obtained. In addition, when the quantity of workpieces is large, the total amount of the electric current required for the plating is increased, and the bath voltage also rises. This large current flows from the anode outside the barrel though openings provided in a wall of the barrel. Hence, there arises a problem that the current concentrates on the openings, so that abnormal deposit of the plating metal called burnt deposit occurs.

In Particular, non-aqueous aluminum plating and aluminum alloy plating have a problem that the bipolar phenomenon easily occurs, and when contact failure occurs in workpieces, bare spots and adhesion failure occur remarkably.

Accordingly, an object of the present invention is to provide a barrel electroplating method which is less prone to bare spots and adhesion failure such as blisters and peeling, and which makes it possible to obtain uniform plated coatings free from burnt deposits or poor brightness, irrespective of the amount of the workpieces.

In particular, an object of the present invention is to provide a barrel electroplating method capable of efficiently plating aluminum or an aluminum alloy on workpieces.

Solution to Problems

To solve the above-described problems, the present invention provides a method for performing barrel electroplating by use of an aluminum or aluminum alloy plating bath, the method comprising a step of rotating, swinging, or vibrating an anode placed inside a barrel receiving workpieces, while rotating, swinging, or vibrating the barrel, with a voltage being applied between the anode and a cathode provided on an inner wall surface of the barrel.

According to the present invention thus configured, the workpieces received in the barrel become electrically continuous to the cathode provided on the inner wall surface of the barrel. The barrel is rotated, swung, or vibrated. In addition, the anode is placed in the barrel, and is rotated, swung, or vibrated by an anode driving unit.

According to the present invention thus configured, the cathode is provided on the inner wall surface of the barrel. Hence, the electrical continuity between workpieces and the cathode is sufficiently ensured. In addition, the anode is placed in the barrel, and is rotated, swung, or vibrated by the anode driving unit. Hence, excessive rise in bath voltage can be prevented. As a result, favorable plated coatings can be obtained, irrespective of the amount of workpieces.

In the present invention, the aluminum or aluminum alloy plating bath is preferably a non-aqueous aluminum plating bath or a non-aqueous aluminum alloy plating bath.

In the present invention, preferred examples of the non-aqueous aluminum plating bath or the non-aqueous aluminum alloy plating bath include the following baths.

An Al plating bath comprises (A) an aluminum halide, and (B) one or two or more compounds selected from the group consisting of N-alkylpyridinium halides, N-alkylimidazolium halides, N,N'-alkylimidazolium halides, N-alkylpyrazolium halides, N,N'-alkylpyrazolium halides, N-alkylpyrrolidinium halides, N,N-alkylpyrrolidinium halides, and ionic liquids of fluorine-containing inorganic anions, organic anions and the like such as $BF4^-$, $PF6^-$, $TFSI^-$, and $BOB^-$.

When the Al plating bath comprises, for example, one or both of (C) a zirconium halide and (D) a manganese halide, an Al—Zr alloy plating bath, an Al—Mn alloy plating bath, or an Al—Zr—Mn plating bath can be obtained. When the Al plating bath comprises a metal other than these metals, an alloy bath of Al with the contained metal is obtained.

The aluminum halide (A) used in the present invention is represented by $AlX_3$, where X is a halogen such as fluorine, chlorine, bromine, or iodine. Chlorine or bromine is preferable. Chlorine is most preferable in consideration of economy.

The N-alkylpyridinium halides used as the compound (B) in the present invention may have an alkyl group on their pyridinium skeletons as a substituent, and, for example, are represented by the following general formula (I):

[Chem. 1]

(I)

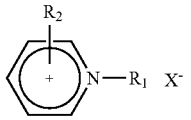

(in the formula, $R_1$ is a linear, branched, or cyclic alkyl group having 1 to 12 carbon atoms, and preferably a linear or branched alkyl group having 1 to 5 carbon atoms; $R_2$ is a hydrogen atom or a linear, branched, or cyclic alkyl group having 1 to 6 carbon atoms, and preferably a linear or branched alkyl group having 1 to 3 carbon atoms; and X is a halogen atom, which is most preferably a bromine atom in consideration of reactivity).

Specific examples of the N-alkylpyridinium halides include N-methylpyridinium chloride, N-methylpyridinium bromide, N-ethylpyridinium chloride, N-ethylpyridinium bromide, N-butylpyridinium chloride, N-butylpyridinium bromide, N-hexylpyridinium chloride, N-hexylpyridinium bromide, 2-methyl-N-propylpyridinium chloride, 2-methyl-N-propylpyridinium bromide, 3-methyl-N-ethylpyridinium chloride, 3-methyl-N-ethylpyridinium bromide, and the like.

The N-alkylimidazolium halides and the N,N'-alkylimidazolium halides used as the compound (B) in the present invention are, for example, represented by the following general formula (II):

[Chem. 2]

(II)

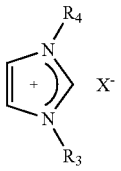

(in the formula, $R_3$ is a linear, branched, or cyclic alkyl group having 1 to 12 carbon atoms, and preferably a linear or branched alkyl group having 1 to 5 carbon atoms; $R_4$ is a hydrogen atom or a linear, branched, or cyclic alkyl group having 1 to 6 carbon atoms, and preferably a hydrogen atom or a linear or branched alkyl group having 1 to 3 carbon atoms; and X is a halogen atom, which is most preferably a bromine atom in consideration of reactivity).

Specific examples of the N-alkylimidazolium halides and the N,N'-alkylimidazolium halides include 1-methylimidazolium chloride, 1-methylimidazolium bromide, 1-ethylimidazolium chloride, 1-ethylimidazolium bromide, 1-propylimidazolium chloride, 1-propylimidazolium bromide, 1-octylimidazolium chloride, 1-octylimidazolium bromide, 1-methyl-3-ethylimidazolium chloride, 1-methyl-3-ethylimidazolium bromide, 1,3-dimethylimidazolium chloride, 1,3-dimethylimidazolium bromide, 1,3-diethylimidazolium chloride, 1,3-diethylimidazolium bromide, 1-methyl-3-propylimidazolium chloride, 1-methyl-3-propylimidazolium bromide, 1-butyl-3-butylimidazolium chloride, 1-butyl-3-butylimidazolium bromide, and the like.

The N-alkylpyrazolium halides and the N,N'-alkylpyrazolium halides used as the compound (B) in the present invention are, for example, represented by the following general formula (III):

[Chem. 3]

(III)

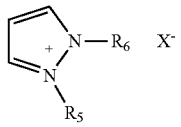

(in the formula, $R_5$ is a linear, branched, or cyclic alkyl group having 1 to 12 carbon atoms, and preferably a linear or branched alkyl group having 1 to 5 carbon atoms; $R^6$ is a hydrogen atom or a linear, branched, or cyclic alkyl group having 1 to 6 carbon atoms, and preferably a hydrogen atom or a linear or branched alkyl group having 1 to 3 carbon atoms; and X is a halogen atom, which is most preferably a bromine atom in consideration of reactivity).

Specific examples of the N-alkylpyrazolium halides and the N,N'-alkylpyrazolium halides include 1-methylpyrazolium chloride, 1-methylpyrazolium bromide, 1-propylpyrazolium chloride, 1-propylpyrazolium bromide, 1-butylpyrazolium chloride, 1-butylpyrazolium bromide, 1-hexylpyrazolium chloride, 1-hexylpyrazolium bromide, 1-methyl-2-ethylpyrazolium chloride, 1-methyl-2-ethylpyrazolium bromide, 1-methyl-2-propylpyrazolium chloride, 1-methyl-2-propylpyrazolium bromide, 1-propyl-2-methylpyrazolium chloride, 1-propyl-2-methylpyrazolium bromide, 1-butyl-2-methylpyrazolium chloride, 1-butyl-2-methylpyrazolium bromide, 1-hexyl-2-methylpyrazolium chloride, 1-hexyl-2-methylpyrazolium bromide, 1,2-dimethylpyrazolium chloride, 1,2-dimethylpyrazolium bromide, 1,2-diethylpyrazolium chloride, 1,2-diethylpyrazolium bromide, and the like.

The N-alkylpyrrolidinium halides and the N,N-alkylpyrrolidinium halides used as the compound (B) in the present invention are, for example, represented by the following general formula (IV):

[Chem. 4]

(IV)

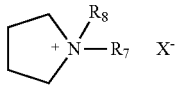

(in the formula, $R_7$ is a hydrogen atom or a linear, branched, or cyclic alkyl group having 1 to 12 carbon atoms, and preferably a linear or branched alkyl group having 1 to 5 carbon atoms; $R_8$ is a hydrogen atom or a linear, branched, or cyclic alkyl group having 1 to 6 carbon atoms, and preferably a hydrogen atom or a linear or branched alkyl group having 1 to 3 carbon atoms, provided that $R_7$ and $R_8$ are not hydrogen atoms simultaneously; and X is a halogen atom, which is most preferably a bromine atom in consideration of reactivity).

Specific examples of the N-alkylpyrrolidinium halides and the N,N-alkylpyrrolidinium halides include 1-methylpyrrolidinium chloride, 1-methylpyrrolidinium bromide, 1,1-dimethylpyrrolidinium chloride, 1-ethyl-1-methylpyrrolidinium chloride, 1-ethylpyrrolidinium chloride, 1-propylpyrrolidinium chloride, 1-methyl-1-propylpyrrolidinium chloride, 1-butyl-1-methylpyrrolidinium chloride, 1-ethyl-1-propylpyrrolidinium chloride, 1-methyl-1-hexylpyrrolidinium chloride, 1-butylpyrrolidinium chloride, 1-ethyl-1-methylpyrrolidinium chloride, and the like.

In addition, the compound (B) may be a mixture of two or more of the above-described N-alkylpyridinium halides, N-alkylimidazolium halides, N,N'-alkylimidazolium halides, N-alkylpyrazolium halides, N,N'-alkylpyrazolium halides, N-alkylpyrrolidinium halides, and N,N-alkylpyrrolidinium halides. Moreover, the compound (B) may be a mixture of two or more thereof having different halogen atoms.

In the present invention, the ratio between the number of moles of the aluminum halide (A) and the number of moles of the compound (B) is preferably in a range from 1:1 to 3:1, and is more preferably 2:1. When the molar ratio is within such a range, it is possible to prevent a reaction which seems to be degradation of pyridinium, imidazolium, pyrazolium, or pyrrolidinium cations, and thereby to prevent degradation of a plating bath and plating failure due to increase in viscosity of the bath.

The zirconium halide (C) used in the present invention is represented by $ZrX_4$, where X is a halogen such as fluorine, chlorine, bromine, or iodine, and is preferably chlorine in terms of handling.

The bath concentration of the zirconium halide is preferably $4\times10^{-4}$ to $4\times10^{-1}$ mol/l, and more preferably $4\times10^{-3}$ to $2\times10^{-1}$ mol/l. With such a bath concentration, the Zr co-deposition ratio in the Al—Zr—Mn alloy-plated coating can be controlled in an appropriate range, and no deposition of Zr as a black powder occurs.

The manganese halide (D) used in the present invention is represented by $MnX_2$, where X is a halogen such as fluorine, chlorine, bromine, or iodine, and is preferably chlorine in terms of handling.

The bath concentration of the manganese halide is preferably $8\times10^{-4}$ to $8\times10^{-1}$ mol/l, more preferably $8\times10^{-3}$ to $4\times10^{-1}$ mol/l, and further preferably $8\times10^{-3}$ to $8\times10^{-2}$ mol/l. With such a bath concentration, the Mn co-deposition ratio in the Al—Zr—Mn alloy-plated coating can be controlled in an appropriate range, and no deposition of Mn as a black powder occurs.

The Al electroplating bath or the Al alloy electroplating bath used in the present invention may comprise (E) an aromatic hydrocarbon solvent, as long as the aromatic hydrocarbon solvent (E) does not exceed 50% by volume. The aromatic hydrocarbon solvent (E) may be any, as long as the aromatic hydrocarbon solvent is a non-aqueous aromatic solvent which is soluble in the molten salt, and which does not lower the electrical conductivity of the molten salt. Examples of the aromatic hydrocarbon solvent (E) include benzene, toluene, xylene, ethylbenzene, cumene, tetralin, mesitylene, hemimellitene, pseudo cumene, and the like. Of these, benzene, toluene, and xylene are preferable, and in particular toluene is most preferable. In addition, the bath concentration of the aromatic hydrocarbon solvent is preferably in a range not exceeding 50% by volume, more preferably in a range from 1 to 50% by volume, and further preferably in a range from 5 to 10% by volume. The use of the aromatic hydrocarbon solvent within such a range improves covering power, so that uniform plating can be obtained. In addition, the use of the aromatic hydrocarbon solvent within such a range does not lower the electrical conductivity or does not increase risk associated with inflammability.

The Al electroplating bath or the Al alloy electroplating bath used in the present invention may comprise (F) one or two or more organic polymers selected from the group consisting of styrene-based polymers and aliphatic diene-based polymer. Specific examples of the styrene-based polymers used as the organic polymer (F) include styrene-based homopolymers such as styrene, α-methylstyrene, vinyltoluene, and m-methylstyrene; copolymers thereof; and copolymers of a styrene-based monomer with another polymerizable vinyl monomer. Examples of the vinyl monomer include maleic anhydride, maleic acid, acrylic acid, methacrylic acid, methyl methacrylate, glycidyl methacrylate, itaconic acid, acrylamide, acrylonitrile, maleimide, vinylpyridine, vinylcarbazole, acrylic acid esters, methacrylic acid esters, fumaric acid esters, vinyl ethyl ether, vinyl chloride, and the like. Of these, α,β-unsaturated carboxylic acids having 3 to 10 carbon atoms and alkyl (having 1 to 3 carbon atoms) esters thereof are preferable.

Examples of the aliphatic diene-based polymers used as the organic polymer (F) include polymers of butadiene, isoprene, pentadiene, or the like; and the like. The aliphatic diene-based polymer is preferably a polymer having branched chains with a 1,2 or 3,4 structure, or a copolymer of the polymer having branched chains with another polymerizable vinyl monomer. Examples of the vinyl monomers include the same vinyl monomers as those mentioned in the description for the styrene-based polymer.

The weight average molecular weight of the organic polymer (F) is preferably in a range from 200 to 80000. In particular, low- to medium-molecular weight polystyrenes and poly-α-methylstyrenes each having a weight average molecular weight of about 300 to 5000 are most preferable, because of good solubility in molten salts. The bath concentration of the organic polymer (F) is preferably in a range from 0.1 to 50 g/l, and more preferably in a range from 1 to 10 g/l. When the organic polymer (F) is used within such a range, deposition of dendrite can be prevented, and the organic polymer (F) exhibits a surface smoothing effect, so that burnt deposit can be prevented from occurring.

The Al electroplating bath or the Al alloy electroplating bath used in the present invention may comprise a (G) brightening agent. The brightening agent (G) maybe one or two or more compounds selected from aliphatic aldehydes, aromatic aldehydes, aromatic ketones, nitrogen-containing unsaturated heterocyclic compounds, hydrazide compounds, S-containing heterocyclic compounds, aromatic hydrocarbons having S-containing substituents, aromatic carboxylic acids, derivatives thereof, aliphatic carboxylic acids having double bonds, derivatives thereof, acetylene alcohol compounds, and fluororesins.

The aliphatic aldehydes are, for example, aliphatic aldehydes having 2 to 12 carbon atoms, and specific examples thereof include tribromoacetaldehyde, metaldehyde, 2-ethylhexyl aldehyde, lauryl aldehyde, and the like.

The aromatic aldehydes are, for example, aromatic aldehydes having 7 to 10 carbon atoms, and specific examples thereof include O-carboxybenzaldehyde, benzaldehyde, O-chlorobenzaldehyde, p-tolualdehyde, anisaldehyde, p-dimethylaminobenzaldehyde, terephthalaldehyde, and the like.

The aromatic ketones are, for example, aromatic ketones having 8 to 14 carbon atoms, and specific examples thereof include benzalacetone, benzophenone, acetophenone, terephthaloyl chloride, benzyl and the like.

The nitrogen-containing unsaturated heterocyclic compounds are, for example, nitrogen-containing heterocyclic compounds having 3 to 14 carbon atoms, and specific examples thereof include pyrimidine, pyrazine, pyridazine, s-triazine, quinoxaline, phthalazine, 1,10-phenanthroline, 1,2,3-benzotriazole, acetoguanamine, cyanuric chloride, imidazole-4-acrylic acid, and the like.

Examples of the hydrazide compounds include maleic hydrazide, isonicotinic hydrazide, phthalic hydrazide, and the like.

The S-containing heterocyclic compounds are, for example, S-containing heterocyclic compounds having 3 to 14 carbon atoms, and specific examples thereof include thiouracil, thionicotinic amide, s-trithiane, 2-mercapto-4,6-dimethylpyrimidine, and the like.

The aromatic hydrocarbons having S-containing substituents are, for example, aromatic hydrocarbons having S-containing substituents and having 7 to 20 carbon atoms, and specific examples thereof include thiobenzoic acid, thioindigo, thioindoxyl, thioxanthene, thioxanthone, 2-thiocoumarin, thiocresol, thiodiphenylamine, thionaphthol, thiophenol, thiobenzamide, thiobenzanilide, thiobenzaldehyde, thionaphthenequinone, thionaphthene, thioacetanilide, and the like.

The aromatic carboxylic acids and the derivatives thereof are, for example, aromatic carboxylic acids having 7 to 15 carbon atoms and derivatives thereof, and specific examples thereof include benzoic acid, terephthalic acid, ethyl benzoate, and the like.

The aliphatic carboxylic acids having double bonds and the derivatives thereof are, for example, aliphatic carboxylic acids having double bonds and having 3 to 12 carbon atoms and derivatives thereof, and specific examples thereof include acrylic acid, crotonic acid, methacrylic acid, 2-ethylhexyl acrylate, 2-ethylhexyl methacrylate, and the like.

Examples of the acetylene alcohol compounds include propargyl alcohol, and the like.

Examples of the fluororesins include trifluorochloroethylene resins having average molecular weights of 500 to 1300, and the like.

The bath concentration of the brightening agent (G) is preferably in a range from 0.001 to 0.1 mol/l, and more preferably in a range from 0.002 to 0.02 mol/l. When the brightening agent (G) is used within such a range in the Al electroplating bath or the Al alloy electroplating bath used in the present invention, a smoothing effect can be obtained. As a result, even when plating is conducted with a high current density, no deposition like black smut is formed.

In the Al electroplating bath or the Al alloy electroplating bath used in the present invention, two of the aromatic hydrocarbon solvent (E), the organic polymer(F), and the brightening agent (G) may be used in combination, or all of the three may be used in combination.

Electroplating is used as a barrel plating method using the Al plating bath, the Al—Zr alloy plating bath, the Al—Mn alloy plating bath, or the Al—Zr—Mn alloy plating bath of the present invention. The electroplating can be conducted with a direct or pulse current, and a pulse current is particularly preferable. It is preferable to use a pulse current under conditions that the duty ratio (ON/OFF ratio) is preferably 1:2 to 2:1, and most preferably 1:1, the ON time is 5 to 20 ms, and the OFF time is 5 to 20 ms, because electrodeposited particles become dense, and flat. The bath temperature is generally in a range from 25 to 120° C., and preferably in a range from 50 to 100° C. It is preferable to employ an electrolysis condition that the current density is in a range from 0.5 to 5 A/dm$^2$, and preferably in a range from 0.5 to 2 A/dm$^2$. The number of revolutions of the barrel is 0.5 to 10 rpm, and preferably 0.5 to 2 rpm. The number of revolutions of the anode is 10 to 200 rpm, and preferably 50 to 100 rpm.

Note that, although the non-aqueous Al plating bath and the Al alloy plating bath of the present invention is safe, even when in contact with oxygen or water. However, it is desirable to conduct the electroplating in a dry oxygen-free atmosphere (in dry nitrogen or dry argon), form the viewpoints of the maintenance of stability of the plating bath, properties of the plating, and the like. In addition, a liquid stirring may be employed in combination. When jet stream, ultrasonic wave stirring, or the like is employed, the current density can be further increased. However, when parts with complicated shapes are plated, it is desirable to conduct the plating for a long period with a low cathode current density of 0.5 to 1 A/dm$^2$, and with no or weak stirring in order to obtain a preferable covering power. The anode maybe Al or an insoluble anode.

Advantageous Effects of Invention

The barrel electroplating method of the present invention is less prone to adhesion failures such as bare spots, blisters, and peeling, and makes it possible to obtain uniform plated coatings free from burnt deposits and poor brightness, irrespective of the amount of workpieces.

In particular, the barrel electroplating method of the present invention enables aluminum or an aluminum alloy to be efficiently plated on workpieces.

DESCRIPTION OF EMBODIMENT

Next, a preferred embodiment of the present invention will be described with reference to the attached drawings.

The present invention has been made based on the following finding. Specifically, the finding is that uniform plated coatings can be obtained by an aluminum or aluminum alloy plating method for conducting plating by use of a barrel electroplating apparatus in which an anode is placed at a center in a barrel, a cathode is placed on an inner wall surface of a barrel, and plating is conducted by rotating, swinging, or vibrating the anode, and swinging, rotating, or vibrating the cathode on the wall surface of the barrel, because this method makes it possible to achieve improvement of a cathode contact which enables workpieces to be always electrically continuous, lowering of bath voltage by shortening the inter-electrode distance, and uniformity in current density by preventing concentration of a current. In addition, the present invention has been made based on also the following finding. Specifically, the finding is that plating conducted with the anode provided in the barrel being rotated makes it possible to improve the anode current efficiency, and to prevent rise in bath voltage, so that uniformity of coatings and an effect of preventing burnt deposits are further enhanced, which enables operation with a high-current-density.

Figure 1:
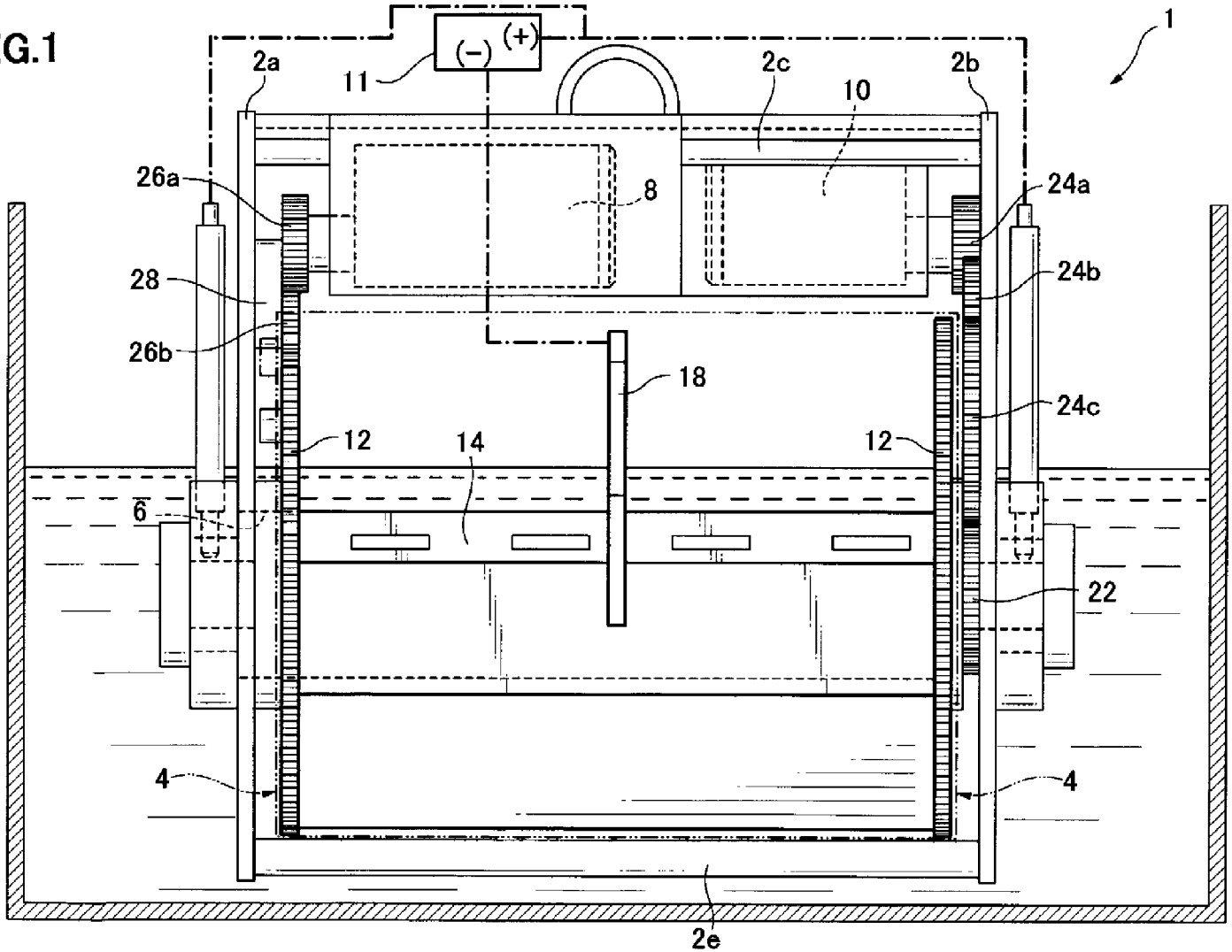
FIG. 1 is a front view of a barrel plating apparatus used in a barrel electroplating method of the present invention.
Figure 2:
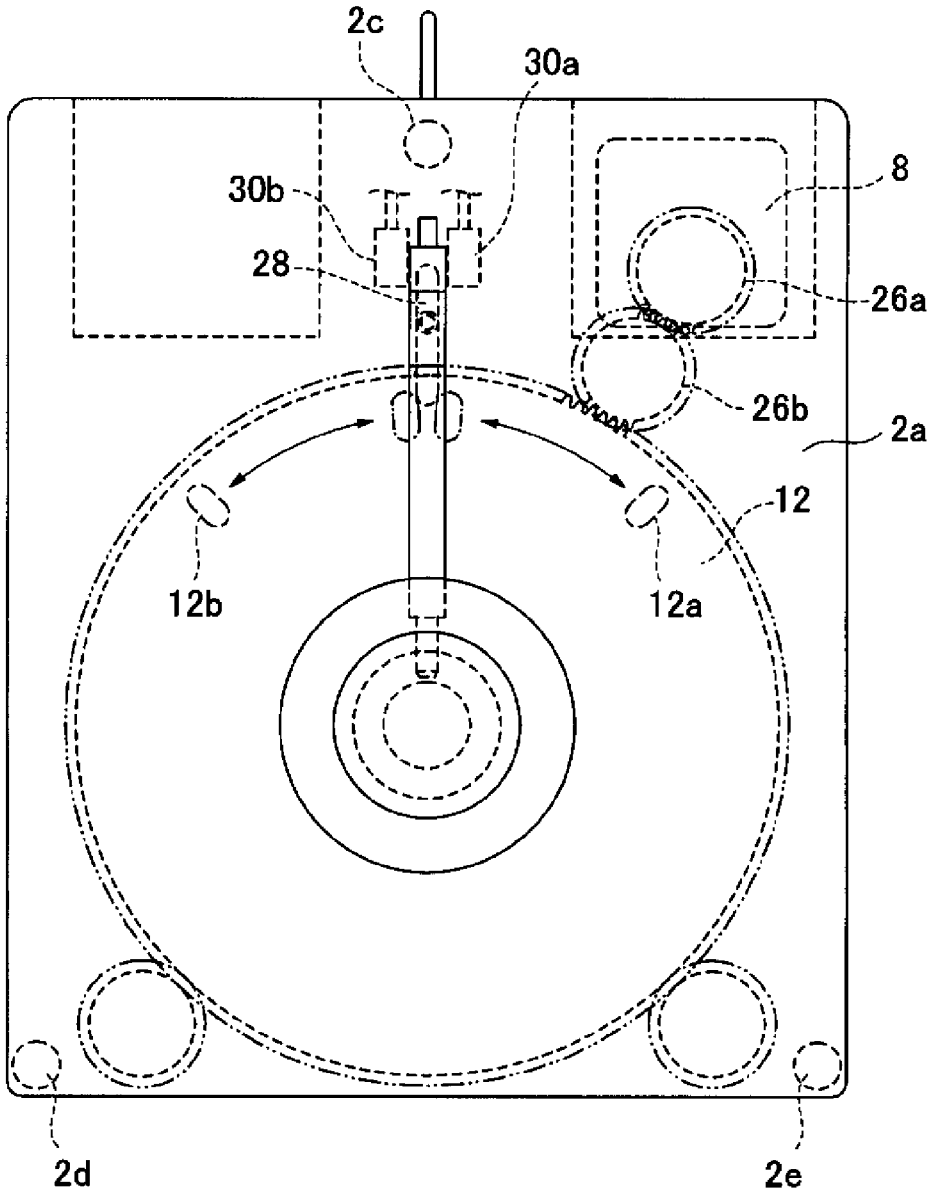
FIG. 2 is a left-side view of the barrel plating apparatus used in the barrel electroplating method of the present invention.
Figure 3:
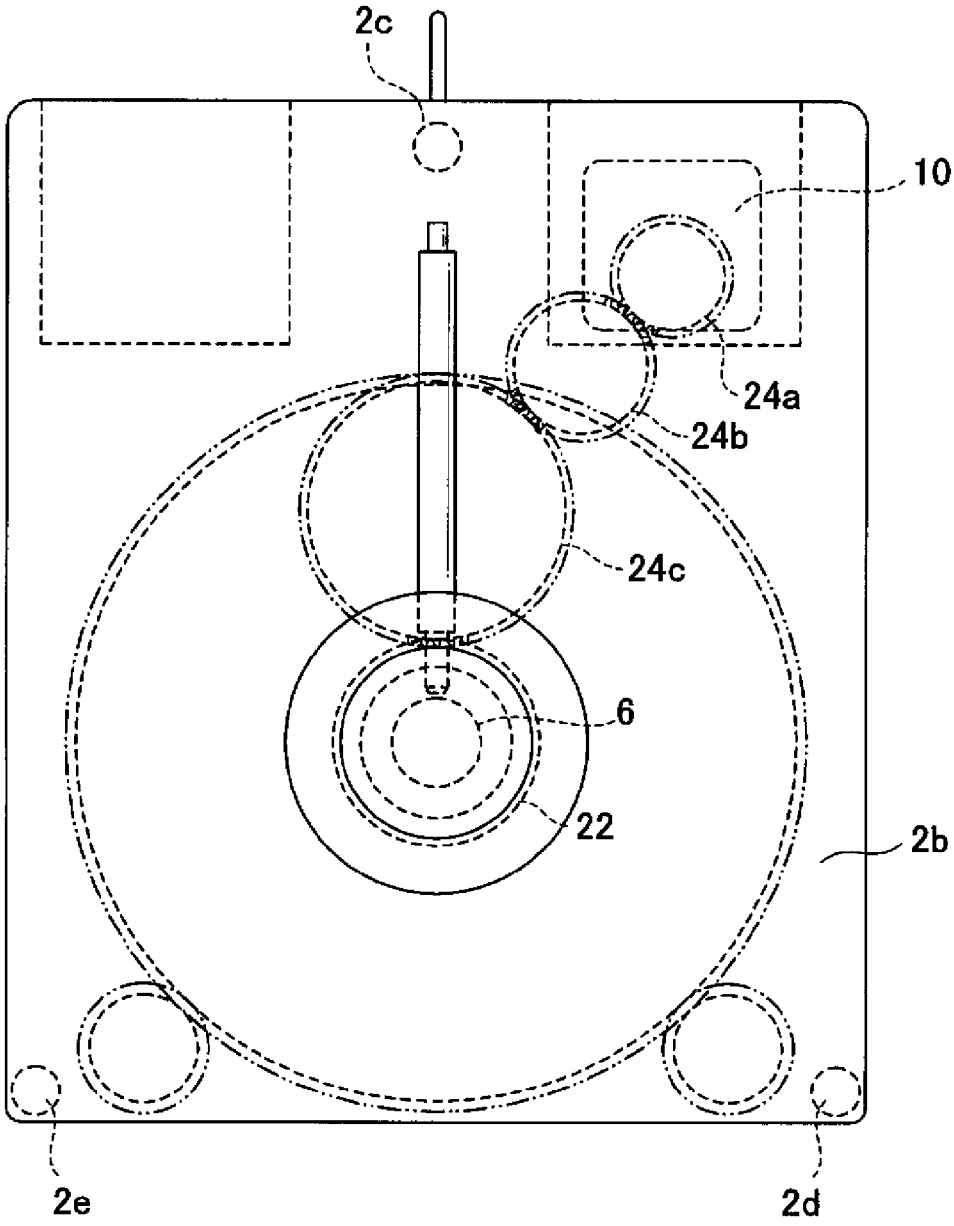
FIG. 3 is a right-side view of the barrel plating apparatus used in the barrel electroplating method of the present invention.
Figure 4:
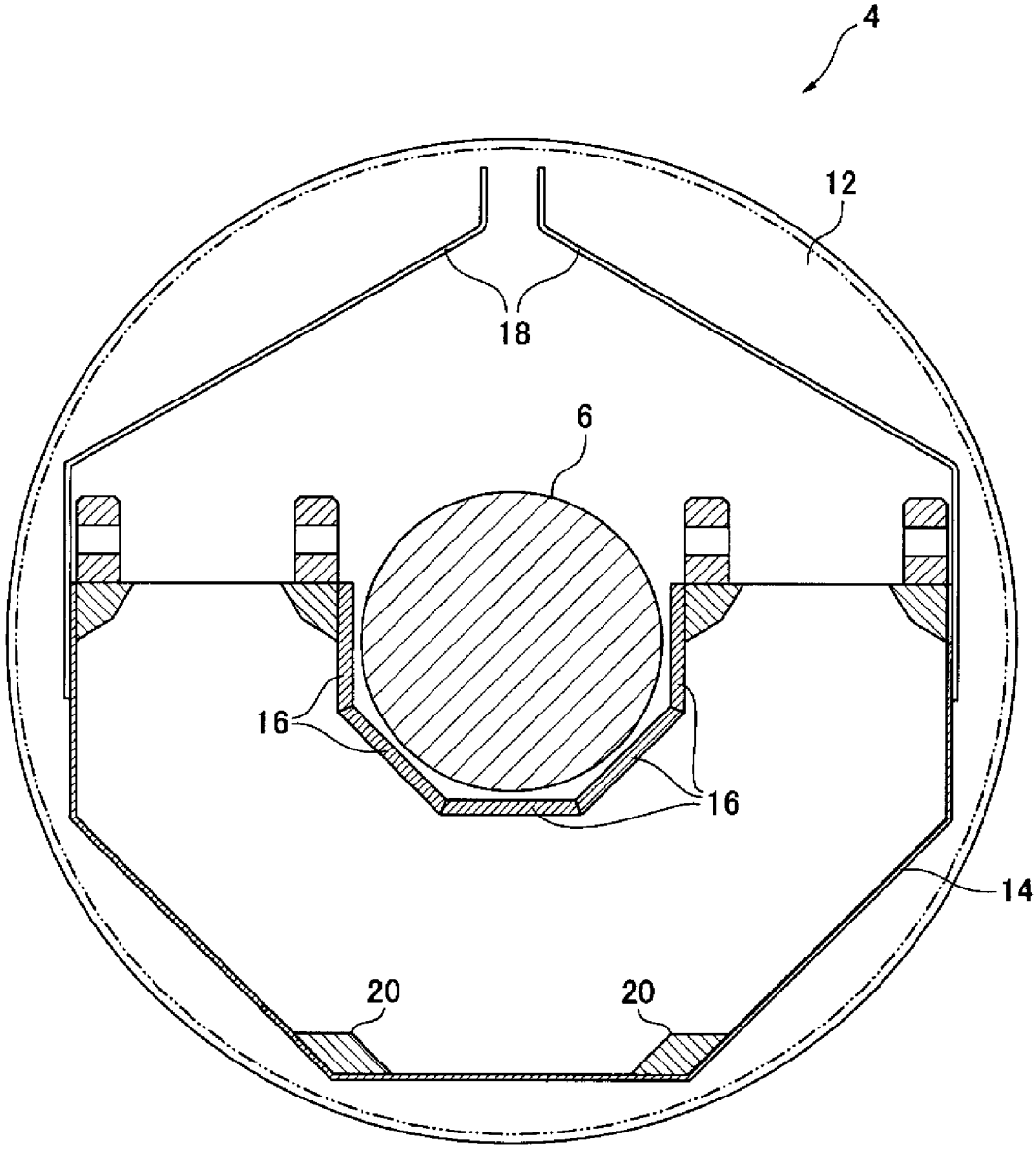
FIG. 4 is a cross-sectional view of a barrel.
Figure 5:
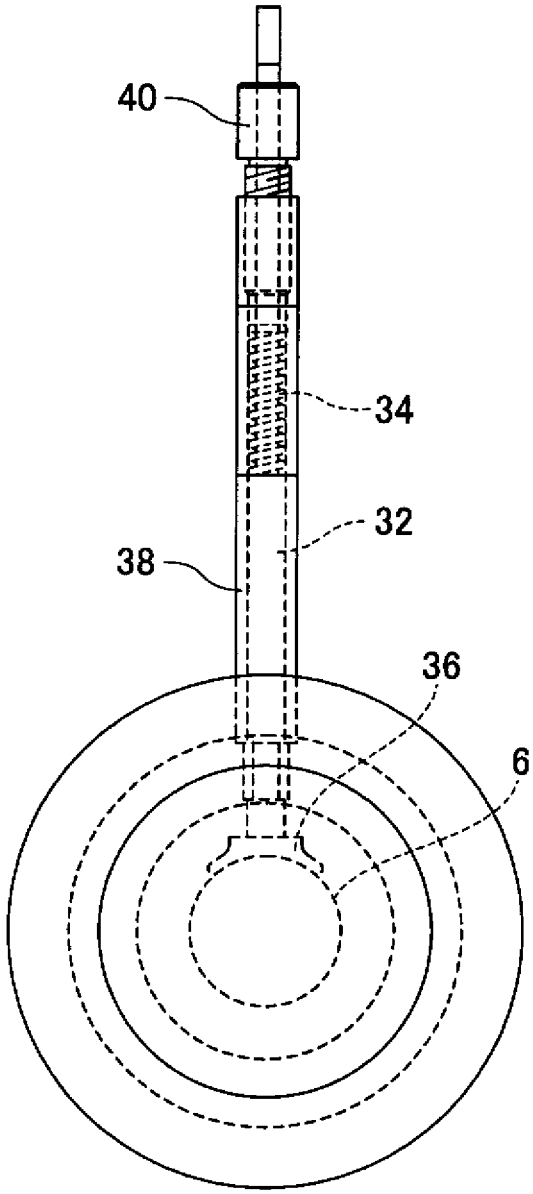
FIG. 5 is a diagram showing a mechanism of an anode electrical contact for applying a positive voltage to an anode.

First, with reference to FIGS. 1 to 5, description is given of a barrel plating apparatus used for carrying out a barrel electroplating method of the present invention. FIG. 1 is a front view of the barrel plating apparatus; FIG. 2 is a left-side view thereof; and FIG. 3 is a right-side view thereof. Meanwhile, FIG. 4 is a cross-sectional view of a barrel. FIG. 5 is a diagram showing a mechanism of an anode electrical contact for applying a positive voltage to an anode.

As shown in FIGS. 1 to 3, a barrel plating apparatus 1 has two frame plates 2*a* and 2*b*, a barrel 4 which is supported by the frame plates swingably with respect to the frame plates, and which has a cathode provided therein, an anode 6 placed on a center axis around which the barrel 4 swings, a barrel-driving motor 8 which is a barrel-driving unit, an anode-driving motor 10 which is an anode driving unit, and a power supply unit 11 configured to apply a voltage between the cathode and the anode 6.

The barrel plating apparatus 1 is a barrel electroplating apparatus using an anode made of aluminum. In this apparatus, small articles such as bolts or screws are received in the barrel 4, and the barrel plating apparatus 1 is immersed to a predetermined position into a plating liquid in a plating liquid tank. Subsequently, while the anode 6 is rotated by activating the anode-driving motor 10, the barrel 4 is swung at a predetermined cycle, and a current flows between the anode 6 and the cathode provided in the barrel 4. Thus, aluminum or aluminum alloy plating is performed on the small articles in the barrel 4.

In this embodiment, the power supply unit 11 is a pulse power supply unit configured to apply a pulse voltage between the cathode and the anode 6.

The frame plates 2*a* and 2*b* are two flat plates formed of an insulator, and connected in parallel with each other by three connecting rods 2*c*, 2*d*, and 2*e*. In addition, the frame plates 2*a* and 2*b* are provided with bearings for swingably supporting the barrel 4 between the frame plates 2*a* and 2*b*. Note that the frame plates 2*a* and 2*b* are made of Teflon (PTFE) in this embodiment.

As shown in FIG. 4, the barrel 4 has two barrel gears 12 having large diameters and being placed on both sides thereof, a metal thin plate 14 placed to connect these barrel gears 12, an anode cover 16, a cathode terminal 18, and baffles 20.

The thin plate 14 is bent into a U shape to form a barrel having a cross section shaped like a half octagon. Workpieces (not shown) are received inside the barrel. The thin plate 14 is a copper plate with a large number of small openings, and an inner surface of the thin plate 14 functions as a cathode provided on an inner wall surface. In operation, a plating liquid flows into or out of the thin plate 14 through the large number of the small openings in the thin plate 14.

Note that, although the cathode is constituted by forming the barrel itself of an electro-conductive material in this embodiment, a conductive cathode plate may be attached to an inner wall surface of a barrel formed of an insulator such as Teflon (registered trademark) in a modification. In addition, although the thin plate 14 is made of aluminum in this embodiment, the barrel 4 may be constituted of a different metal such as nickel, stainless steel, or titanium; carbon; or an electro-conductive resin.

The anode cover 16 is formed of five plate-shaped members, and placed to cover roughly a lower half of the anode 6 placed in the barrel 4. This anode cover 16 prevents accidental contact of the workpieces with the anode 6, for example, in the case where the quantity of workpieces is large. A large number of small openings are formed in the anode cover 16. Thus, the anode cover 16 is configured such that a current flows from the anode to the workpieces through these small openings. Note that the anode cover 16 is made of Teflon in this embodiment.

The cathode terminal 18 includes elongated metal plates extending from both sides of the thin plate 14, and is connected to a negative terminal of the power supply unit 11 (FIG. 1).

The baffles 20 are quadrangular-prism-shaped members placed at corner portions of the bent thin plate 14. The baffles 20 form mountains having triangular cross-sections inside the barrel 4. Due to the formation of the mountains inside the barrel 4, the baffles 20 enable well-mixing of the workpieces when the barrel 4 is swung.

As shown in FIGS. 1 to 3, the anode 6 is a stepped and shaft-shaped Al circular cylinder having such a structure that diameters of both side potions are small. Both the side potions of the anode 6 penetrate through the frame plates 2*a* and 2*b*, respectively. Thus, the anode 6 is supported by the frame plates 2*a* and 2*b* rotatably with respect to the frame plates 2*a* and 2*b*. In addition, an anode-driving gear 22 is attached to a step portion of the anode 6. In a modification, the anode 6 may be shaped like a barrel by forming a hollow anode. Alternatively, the anode 6 may be formed by attaching a soluble or insoluble anode material to a surface of a hollow barrel formed of a plastic and/or a metal in an exchangeable manner. Aluminum or the like can be used for the anode. Preferably, projections and recesses shaped like dimples of golf balls are formed on a surface of the anode 6.

As shown in FIG. 3, the anode-driving motor 10 placed in an upper portion of the barrel plating apparatus 1 rotationally drives the anode-driving gear 22 via the transmission gears 24*a*, 24*b*, and 24*c* attached to the frame plate 2*b*. Thus, the anode 6 is rotationally driven.

On the other hand, as shown in FIG. 2, the barrel-driving motor 8 placed in an upper portion of the barrel plating apparatus 1 drives the barrel gears 12 via transmission gears 26*a* and 26*b* attached to the frame plate 2*a*. In addition, protrusions 12*a* and 12*b* are provided to the barrel gears 12. When the barrel gears 12 rotate around the anode 6, the protrusions 12*a* and 12*b* are moved, so that a rod 28 rotatably attached to the frame plate 2*a* is rotated. A tip portion of the rotated rod 28 switches micro switches 30*a* and 30*b* placed on both sides of the tip portion to On or Off. Specifically, when the barrel gears 12 are rotated counterclockwise in FIG. 2, the protrusion 12*a* pushes a lower end portion of the rod 28 to the left, and the rod 28 is rotated clockwise. As a result, an upper end portion of the rod 28 pushes the micro switch 30*a* to turn the micro switch 30*a* on. When the micro switch 30*a* is turned on, the rotation of the barrel-driving motor 8 is reversed, and consequently the barrel gears 12 are rotated clockwise.

When the barrel gears 12 are rotated clockwise, the protrusion 12*b* pushes a lower end portion of the rod 28 to the right, and the rod 28 is rotated counterclockwise. As a result, the upper end portion of the rod 28 pushes the micro switch 30*b* to turn the micro switch 30*b* on. When the micro switch 30*b* is turned on, the rotation of the barrel-driving motor 8 is reversed, and consequently the barrel gears 12 are again rotated counterclockwise. By repeating the described above operations, the barrel 4 is swung over an angle range of approximately 90°.

Next, with reference to FIG. 5, a structure of an anode electrical contact portion is described.

As shown in FIG. 5, the anode electrical contact portion has a rod-shaped anode terminal 32, a coil spring 34 configured to bias the anode terminal 32, a fixed-side contact member 36 which is a member on a fixed side and configured to be brought into contact with the anode 6, an insulating sleeve 38 through which the anode terminal 32 penetrates, and a spring adjusting bolt 40 configured to adjust a biasing force of the coil spring 34. Note that, in operation, the anode electrical contact portion is immersed in a plating liquid, and the anode 6 is slid with respect to the fixed-side contact member 36.

The anode terminal 32 is a shaft stepped such that an upper portion thereof is formed thin. An upper end of the anode terminal 32 is connected to a positive terminal of the power supply unit 11, and the fixed-side contact member 36 is attached to a lower end of the anode terminal 32. In addition, the thin upper portion of the anode terminal 32 penetrates through the coil spring 34, and a step portion of the anode terminal 32 is configured to engage with a lower end of the coil spring 34.

The fixed-side contact member 36 is made of titanium, and is screwed onto a lower end portion of the anode terminal 32. In addition, a bottom surface of the fixed-side contact member 36 is formed like a barrel surface, so that the fixed-side contact member 36 slid over a wide contact area with a small-diameter portion of the anode 6. The anode 6 is rotated, while the bottom surface of the fixed-side contact member 36 on the fixed-side of the anode electrical contact is being in contact with the anode 6 made of Al on a movable side of the anode electrical contact. As a result, a current flows from the positive terminal of the power supply unit 11 to the anode 6, through the anode terminal 32 and the fixed-side contact member 36.

Note that, in a modification, the fixed-side contact member 36 and/or the movable side of the anode electrical contact can also be formed of a corrosion-resistant metal material such as titanium or a titanium alloy.

The insulating sleeve 38 is a pipe made of Teflon, and is placed to cover the anode terminal 32 and the coil spring 34. Meanwhile, the spring adjusting bolt 40 is a bolt-shaped member made of Teflon having a bore formed at a center thereof. The spring adjusting bolt 40 is formed to be screwed onto an upper portion of the insulating sleeve 38. The anode terminal 32 penetrates through the bore of the spring adjusting bolt 40. The spring adjusting bolt 40 is placed such that a tip of the spring adjusting bolt 40 presses an upper end of the coil spring 34. Accordingly, by rotating the spring adjusting bolt 40, the force of compressing the coil spring 34 changes, which makes it possible to adjust the force of pressing the fixed-side contact member 36 to the anode 6.

Next, description is given of an example of the barrel electroplating method of the present invention using the barrel plating apparatus 1.

First, small articles, such as bolts or screws made of iron, which are workpieces, are introduced into the barrel 4 of the barrel plating apparatus 1. Thus, each workpiece becomes electrically continuous to the cathode by direct contact with the inner wall surface of the barrel 4, or through other workpieces in contact with the inner wall surface of the barrel 4. Note that examples of substrates, which are workpieces, include metals and alloys such as various metals including nickel and copper, as well as alloys thereof, in addition to iron. Meanwhile, examples of the workpieces include bolts, nuts, washer, small pressed products, as well as those having various shapes such as cuboids, circular cylinders, barrels, and spheres.

After the workpieces are introduced into the barrel 4, the barrel plating apparatus 1 is immersed to a predetermined position into a plating tank into which a plating liquid is introduced. Specifically, the barrel plating apparatus 1 is immersed in the plating liquid such that the barrel 4 and the anode 6 are completely immersed in the plating liquid, and the barrel-driving motor 8 and the anode-driving motor 10 are located above a liquid surface of the plating liquid. Note that any of the non-aqueous aluminum plating baths and the non-aqueous aluminum alloy plating baths shown above as examples can be preferably used as a non-aqueous aluminum plating bath or a non-aqueous aluminum alloy plating bath in the present invention.

Next, the barrel-driving motor 8 and the anode-driving motor 10 are activated. The anode 6 is rotated by a driving force of the anode-driving motor 10 at approximately 50 to 100 rpm around a center axis of the anode 6. On the other hand, the barrel gears 12 of the barrel 4 are rotationally driven by a driving force of the barrel-driving motor 8 at a rotation speed of approximately 1 rpm, and are swung such that the rotating direction is reversed after every rotation by approximately 90°.

In addition, for example, a pulse current of 50 A at 10 V is applied by the power supply unit 11 between the anode terminal 32 and the cathode terminal 18. Thus, the current flows through the anode terminal 32, the fixed-side contact member 36, the anode 6, the plating liquid, the workpieces, and the cathode (the inner wall surface of the barrel 4). Note that the current flows between the anode terminal 32 and the cathode terminal 18 may be a direct current instead. In addition, the bath temperature depends on the plating liquid, and is set to generally 25 to 120° C., and preferably 50 to 100° C. It is preferable to employ an electrolysis condition that the current density is 0.1 to 5 $A/dm^2$, preferably 0.5 to 2 $A/dm^2$, and further preferably 0.5 to 1.0 $A/dm^2$. Note that the plating liquid in the barrel 4 is preferably circulated during the plating, while a filter (not shown) is used.

Moreover, when the barrel 4 is swung, workpieces in the barre 14 are mixed, so that uniform plating layers are formed on surfaces of the workpieces. In addition, the baffles 20 provided in the barrel 4 promote the mixing of the workpieces in the barrel 4, so that more uniform plating layers are formed. In addition, since the inner wall surface of the barrel 4 constitutes the cathode, the electric continuity of the workpieces to the cathode is ensured, so that the bipolar phenomenon is prevented from occurring even in a state where the quantity of the workpieces are small and the workpieces are not in contact with each other. Moreover, since the anode cover 16 is placed around the anode 6, the workpieces are prevented from being in direct contact with the anode 6, even when the quantity of the workpieces is large.

In addition, since the anode 6 immersed in the plating liquid is rotated, a flow of the plating liquid is always created around the anode 6, so that an abnormal rise in the bath voltage (the voltage between the anode terminal 32 and the cathode terminal 18) can be prevented. Moreover, since the anode 6 is placed in the barrel 4 at a position relatively close to the cathode, and since workpieces are placed around the anode 6, the area of the anode 6 exposed to the workpieces is increased, so that black deposits and burnt deposits due to a concentrated current are prevented from occurring.

After a predetermined period, the application of the voltage by the power supply unit 11 is stopped, and the barrel plating apparatus 1 is lifted out of the plating liquid tank. Thus, the plating operation is completed. This method enables formation of aluminum or aluminum alloy plating having any thickness. The thickness of the plating is preferably 2 μm or more, and more preferably 3 to 25 μm.

In particular, an Al—Zr—Mn alloy plating bath is preferable.

EXAMPLES

Next, description is given of Example in which plating was actually conducted by use of the barrel electroplating method of the present invention.

Example 1

Aluminum alloy plating was conducted on M8 bolts by use of the barrel plating apparatus 1 (5-kg barrel) in which the cathode was an Al plate, and the anode was Al. The amount of the bolts introduced was varied between 1 to 5 kg. First, for pretreatments, the bolts were subjected to alkaline degreasing, electrolytic alkaline cleaning, and acid cleaning, and then plated with Ni, followed by thorough washing with water. Water was substituted with ethanol, and then the bolts were dried.

As for the composition of a plating bath, an Al—Zr—Mn alloy electroplating bath was prepared by adding 10 g/L of manganese chloride and 1 g/l of zirconium chloride to a bath obtained by mixing and melting $AlCl_3$ and 1-methyl-3-propylimidazolium bromide at a molar ratio of 2:1. In a dry nitrogen gas atmosphere, the bolts were immersed in the Al—Zr—Mn alloy electroplating bath kept at 100° C. for 5 minutes. Then, Al—Zr—Mn alloy plating was conducted in the same plating bath with a pulse current (duty ratio: 1/1, ON time: 10 ms, and OFF time: 10 ms) . Plating conditions were as follows: current density: 1 A/dm$^2$; plating time: 120 minutes; and bath temperature: 100° C. As shown in Table 1, as a result of the Al—Zr—Mn alloy plating, bright aluminum alloy-plated coatings were successfully obtained in any of cases of the introduction amounts of 1 to 5 kg.

TABLE 1

| No. | Introduction amount (kg) | Total current amount (A) | Average coating thickness (μm) | Plating appearance | Adhesion (Blister · Peeling) |
|---|---|---|---|---|---|
| 1 | 1 | 12 | 8 | Bright | None |
| 2 | 2 | 24 | 8 | Bright | None |
| 3 | 3 | 36 | 8 | Bright | None |
| 4 | 5 | 60 | 8 | Bright | None |

Comparative Example 1

Figure 6:
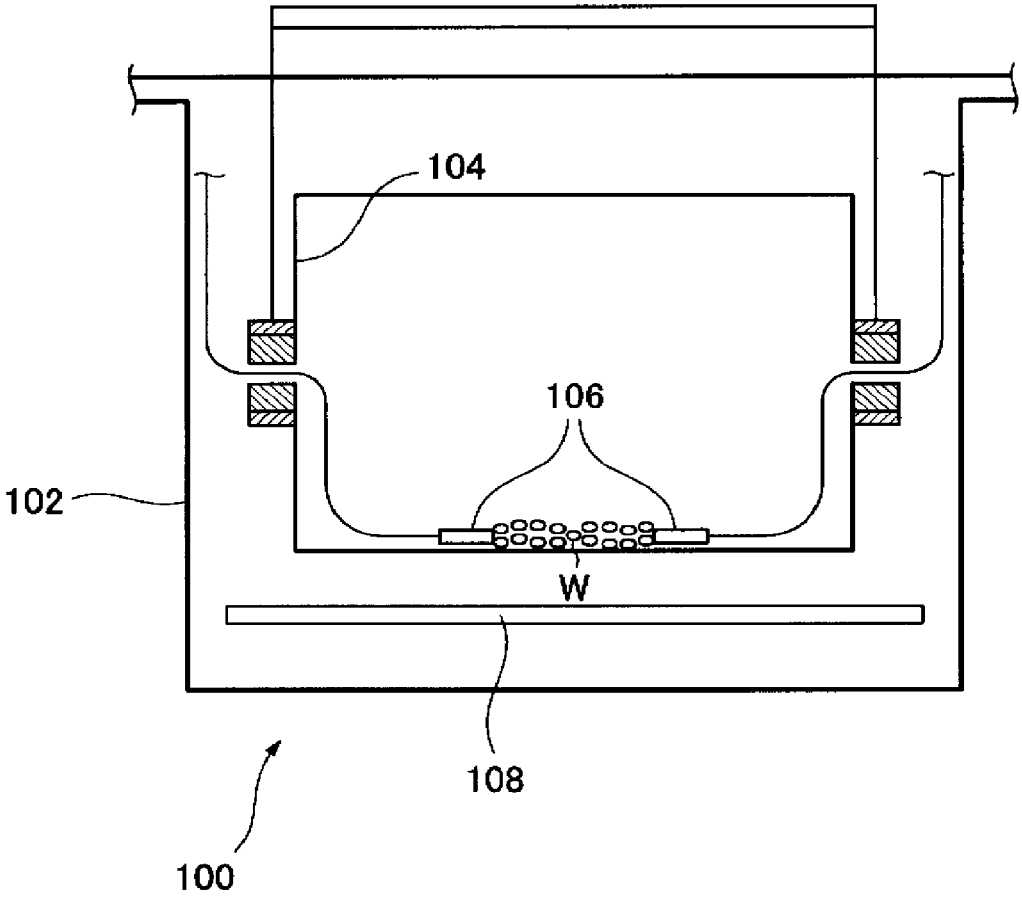
FIG. 6 is a cross-sectional view schematically showing a structure of a barrel plating apparatus used in a conventional barrel electroplating method.

Next, description is given of results of a comparative example in which aluminum alloy plating was conducted on M8 bolts by use of the conventional barrel plating apparatus (5 kg) shown in FIG. 6.

The cathode was Cu, and the anode was an Al plate. The amount of the bolts introduced was varied between 1 to 5 kg. First, for pretreatments, the bolts were subjected to alkaline degreasing, electrolytic alkaline cleaning, and acid cleaning, and then plated with Ni, followed by thorough washing with water. Water was substituted with ethanol, and then the bolts were dried.

As for the composition of a plating bath, an Al—Zr—Mn alloy electroplating bath was prepared by adding 20 g/L of manganese chloride and 1 g/l of zirconium chloride to a bath obtained by mixing and melting $AlCl_3$ and 1-methyl-3-propylimidazolium bromide at a molar ratio of 2:1. In a dry nitrogen gas atmosphere, the bolts were immersed in the Al—Zr—Mn alloy electroplating bath kept at 100° C. for 5 minutes. Then, Al—Zr—Mn alloy plating was conducted in the same plating bath with a pulse current (duty ratio: 1/1, ON time: 10 ms, and OFF time: 10 ms). Plating conditions were as follows: current density: 1 A/dm$^2$, plating time: 120 minutes; and bath temperature: 100° C. As shown in Table 2, as a result of the Al—Zr—Mn alloy plating, only dull aluminum alloy plated coatings with bare spots or burnt deposits and with poor adhesion were obtained in each of the cases of the introduction amounts of 1 to 5 kg.

TABLE 2

| No. | Introduction amount (kg) | Total current amount (A) | Average coating thickness (μm) | Plating appearance | Adhesion (Blister · Peeling) |
|---|---|---|---|---|---|
| 1 | 1 | 12 | 0 to 3 | Bare spots | Present |
| 2 | 2 | 24 | 0 to 3 | Bare spots | Present |
| 3 | 3 | 36 | 3 to 8 | Non-uniformity | Present |
| 4 | 5 | 60 | 8 | Burnt deposits | Present |

As described above, neither bare spots nor plating failure occurred in Example 1, because the workpieces were always in contact with the cathode even when the amount of the bolts introduced, which were workpieces, was small. In contrast, bare spots and plating failure such as adhesion failure occurred in Comparative Example 1 where the conventional barrel plating apparatus was used, because the contact between the workpieces and the cathodes was insufficient when the amount of the workpieces introduced was small. This was presumably because the bipolar phenomenon occurred in workpieces having insufficient electrical continuity to the cathodes.

According to the aluminum or aluminum alloy barrel electroplating method of the embodiment of the present invention, a uniform-plated coating free from burnt deposits and poor brightness can be obtained, without being greatly affected by the amount of workpieces, and without bare spots or adhesion failure such as blisters or peeling. As described above, the present invention makes it possible to efficiently perform aluminum plating or aluminum alloy plating with high quality, and hence is expected to find wide applications such as auto parts and home appliance parts.

Hereinabove, the preferred embodiment of the present invention is described. However, various modifications can be made to the above-described embodiment. In particular, although the anode is rotated in the barrel in the above-described embodiment, the barrel plating apparatus can be configured such that the anode is swung or vibrated.

Moreover, although the barrel is swung or rotated in the above-described embodiment, the barrel plating apparatus can be configured such that the barrel is vibrated.

REFERENCE SIGNS LIST

1 Barrel plating apparatus used in barrel electroplating method of the present invention
2*a*, 2*b* Frame plate
2*c*, 2*d*, 2*e* Connecting rod
4 Barrel
6 Anode
8 Barrel-driving motor (barrel-driving unit)
10 Anode-driving motor (anode driving unit)
11 Power supply unit
12 Barrel gear
14 Thin plate
16 Anode cover
18 Cathode terminal

20 Baffle
22 Anode-driving gear
24*a*, 24*b*, 24*c* Transmission gear
26*a*, 26*b* Transmission gear
28 Rod
30*a*, 30*b* Micro switch
32 Anode terminal
34 Coil spring
36 Fixed-side contact member
38 Insulating sleeve
40 Spring adjusting bolt
10 Conventional barrel electroplating apparatus
10 Plating tank
10 Barrel
10 Cathode
10 Anode
W Workpiece

The invention claimed is:

1. A method for performing barrel electroplating by use of an aluminum or aluminum alloy plating bath, the method comprising a step of:

rotating, swinging, or vibrating an anode, while rotating, swinging, or vibrating a barrel receiving workpieces, with a voltage being applied between the anode and a cathode provided on an inner wall surface of the barrel;

wherein the anode is placed inside the barrel, and is covered with an anode cover having openings through which a current from the anode flows to the workpieces, such that accidental contact of the workpieces with the anode is prevented and wherein the anode cover partially surrounds the anode.

2. The barrel electroplating method according to claim 1, wherein the aluminum or aluminum alloy plating bath is a non-aqueous aluminum plating bath or a non-aqueous aluminum alloy plating bath.

3. The barrel electroplating method according to claim 2, wherein the non-aqueous aluminum plating bath or non-aqueous aluminum alloy plating bath is a non-aqueous aluminum plating bath comprising:

(A) an aluminum halide; and (B) an ionic liquid.

4. The barrel electroplating method according to claim 2, wherein the non-aqueous aluminum plating bath or non-aqueous aluminum alloy plating bath is an Al—Zr alloy plating bath, an Al—Mn alloy plating bath, or an Al—Zr—Mn plating bath, which comprises:

(A) an aluminum halide; and (B) an ionic liquid;

which further comprises one or both of:

(C) a zirconium halide; and (D) a manganese halide.

5. The barrel electroplating method according to claim 1, wherein a bath temperature is 25 to 120° C., an average cathode current density is 0.5 to 5 A/dm$^2$, the angular velocity of the barrel is 180 to 3600 degrees/minute, and the rate of rotation of the anode is 10 to 200 rpm.

* * * * *

UNITED STATES PATENT AND TRADEMARK OFFICE

CERTIFICATE OF CORRECTION

PATENT NO. : 8,916,039 B2
APPLICATION NO. : 13/502442
DATED : December 23, 2014
INVENTOR(S) : Manabu Inoue et al.

It is certified that error appears in the above-identified patent and that said Letters Patent is hereby corrected as shown below:

In the Specification

At column 8, line 5, the printed patent incorrectly reads “form the viewpoints of”. This is a typographical error and should read instead as -- from the viewpoints of --.

At column 12, line 36, the printed patent incorrectly reads “barre 14 are mixed”. This is a typographical error and should read instead as -- barrel 4 are mixed --.

Signed and Sealed this
Thirtieth Day of June, 2015

Michelle K. Lee

Michelle K. Lee
*Director of the United States Patent and Trademark Office*